United States Patent [19]

Satake

[11] 4,316,799

[45] Feb. 23, 1982

[54] AUTOMATIC CONTROL APPARATUS FOR AN OSCILLATING GRAIN SEPARATOR

[75] Inventor: Toshihiko Satake, Higashihiroshima, Japan

[73] Assignee: Satake Engineering Company, Ltd., Tokyo, Japan

[21] Appl. No.: 191,214

[22] PCT Filed: Apr. 5, 1979

[86] PCT No.: PCT/JP79/00087

§ 371 Date: Mar. 28, 1980

§ 102(e) Date: Feb. 1, 1980

[87] PCT Pub. No.: WO80/00316

PCT Pub. Date: Mar. 6, 1980

[30] Foreign Application Priority Data

Jul. 28, 1978 [JP] Japan ..... 53-92770

[51] Int. Cl.[3] ..... B07B 13/18

[52] U.S. Cl. ..... 209/504; 209/480; 209/491; 209/580; 209/587

[58] Field of Search ..... 209/1, 490, 491, 496, 209/503, 504, 508, 479–481, 577, 580, 587, 588, 635, 691, 694, 695, 441, 442, 466–469, 471, 472

[56] References Cited

U.S. PATENT DOCUMENTS

| | | | |
|---|---|---|---|
| 1,039,132 | 9/1912 | Hughes | 209/694 |
| 3,807,554 | 4/1974 | Satake | 209/694 |
| 3,926,793 | 12/1975 | Wise | 209/508 X |
| 3,933,249 | 1/1976 | Welsh et al. | 209/441 X |
| 3,977,526 | 8/1976 | Gordon et al. | 209/565 |

FOREIGN PATENT DOCUMENTS

| | | | |
|---|---|---|---|
| 1132872 | 7/1962 | Fed. Rep. of Germany | 209/491 |
| 41-18720 | 8/1966 | Japan . | |
| 48-26146 | 8/1973 | Japan . | |
| 48-37727 | 11/1973 | Japan . | |
| 50-17377 | 6/1975 | Japan . | |
| 50-62285 | 6/1975 | Japan . | |
| 345275 | 3/1931 | United Kingdom | 209/468 |
| 703694 | 2/1954 | United Kingdom | 209/587 |

*Primary Examiner*—Ralph J. Hill

*Attorney, Agent, or Firm*—Lowe, King, Price & Becker

[57] ABSTRACT

An oscillating grain separator comprised a grain separating plate provided with a rugged surface which oscillates in the angle direction of elevation for shaking up grain and mixed grain is separated at one at front side and/or rear side of the separating plate and flow out sideways from the plate, an oscillating grain separator having photoelectric means consisting of a light source and a light receiving element for detecting the flow conditions of the grain on the grain separating plate and automatically controlling the angle of elevation, mean oscillating angle, frequency or amplitude of the grain separating plate for normal control of the grain flow.

5 Claims, 14 Drawing Figures

AUTOMATIC CONTROL APPARATUS FOR AN OSCILLATING GRAIN SEPARATOR

DESCRIPTION

1. Technical Field

This invention relates to an automatic control apparatus for an oscillating grain separator.

2. Background Art

Prior art grain separating systems comprise an oscillating grain separator provided with a grain separating plate having a rough surface which is inclined relative to a horizontal plane and which oscillates at a mean oscillating angle that is larger than the angle of elevation. The plate shakes up grain and separates mixed grain toward one side of a grain separating plate at the front and rear thereof so that mixed grain is removed sideways. There is a phenomenon, however, wherein more grain on top of the grain separating plate gathers in a curved path toward the rear of the plate when the angle of elevation of the grain separating plate increases. More grain tends to gather in a curved path toward the front of the plate when the mean oscillating angle, frequency or amplitude increases and the grain separating operation is determined by the flow distribution of grain. Therefore, if there is a change in flow distribution, immediate adjustment of same to a normal flow rate is necessary. In the past, such adjustment was performed manually by adjusting the angle of elevation of the grain separating plate.

However, it was difficult to cope with and adjust the flow distribution of grain.

DISCLOSURE OF INVENTION

It is a primary object of the present invention to provide an automatic control apparatus on an oscillating grain separator which detects changes in light rays projected from a light source, caused by grain. The amount of light received by a light receiving element emits a signal to rotate a driving means in either a clockwise or counterclockwise direction, constantly adjusting factors such as angle of elevation, mean oscillating angle, frequency, amplitude and the like automatically to maintain normal flow to thereby obtain high accuracy in the grain separating operation.

In order to attain the above-mentioned object, this invention relates to an automatic control apparatus for an oscillating grain separator wherein a light source and a light receiving element are mounted in a detecting area to detect grain flow on the grain separating plate, gathering on at least either one of the front or rear grain separating plate frames. The grain separating plate is provided with a rough surface oscillating in direction horizontal to the angle of elevation of the surface and the side wall formed around the grain separating plate. An electrical circuit comprising a driving means for adjusting the grain flow condition is connected to the light receiving element.

Automation of the grain separating operation by adjusting the flow of grain on the grain separating plate with a photoelectric means substantially improves the grain separating accuracy and improves energy conservation.

Another object of this invention is to provide an automatic control apparatus of an oscillating grain separator having an area for detecting grain flow conditions on the grain separating plate located on an upper portion of the grain separating plate frame.

Still another object of this invention is to provide an automatic control apparatus of an oscillating grain separator wherein the detecting area for detecting grain flow on the grain separating plate is located on the upper and lower portions of the grain separating plate frame.

A further object of this invention is to provide an automatic control apparatus for an oscillating grain separator having a detecting area for detecting grain flow conditions on the grain separating plate located on the lower portion of the grain separating plate frame.

A still further object of this invention is to provide an automatic control apparatus for an oscillating grain separator wherein a detecting area, for detecting grain flow conditions on said grain separating plate, is located on the side portion of the side wall in an grain separating plate frame.

A still further object of this invention is to provide an automatic control apparatus for an oscillating grain separator wherein an area for checking grain flow conditions on said grain separating plate is located on a lower part of a side wall in a grain separating plate frame and on an upper part of said grain separating plate.

A still further object of this invention is to provide an automatic control apparatus for an oscillating grain separator wherein a driving means, for adjusting grain flow conditions, is a controlling motor which rotates around a threaded shaft threadably engaged to an adjusting lever which rotates around a rotary lever of a grain separating plate frame.

A still further object of this invention is to provide an automatic control apparatus of an oscillating grain separator wherein a rotary lever is bridged across a standing frame at a common point where an oscillating lever supports a grain separating plate frame and wherein an eccentric means is connected to the oscillating lever.

A still further object of this invention is to provide an automatic control apparatus of an oscillating grain separator wherein the rotary lever is bridged across a standing frame between a front and rear oscillating levers, each of which supports a grain separating plate frame and wherein an eccentric means is connected to the oscillating levers.

A still further object of this invention is to provide an automatic control apparatus of an oscillating grain separator wherein the driving means for adjusting grain flow conditions is a variable speed means for controlling the motion frequency of the grain separating plate frame.

BEST MODE FOR CARRYING OUT THE INVENTION

Figure 1:
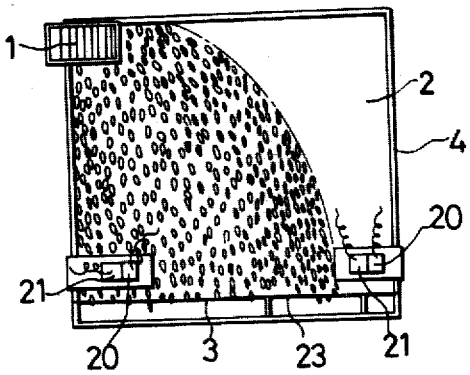
FIGS. 1 and 2 are a plan view and vertical-sectional view, respectively, of the principal parts of an embodiment according to the present invention.
Figure 3:
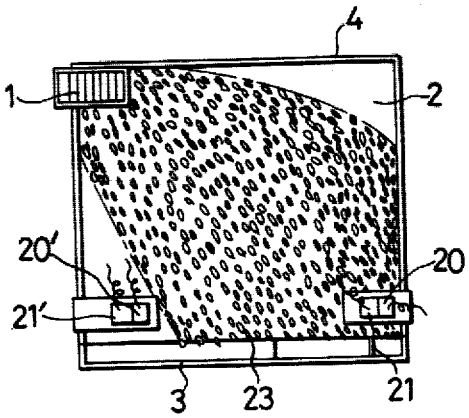
FIGS. 3 and 4 are vertical-sectional view and plan view, respectively, of principal parts which are different from those in FIG. 1 and FIG. 2.
Figure 4:
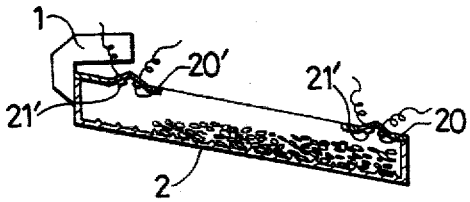

The relations among flowing phenomena of grain, such as unhulled rice, incompletely hulled rice and hulled rice on the grain separating plate and a photoelectric means thereof are illustrated in the accompanying drawings. FIGS. 1 and 3 show the flow of unhulled, incompletely hulled and hulled rice on the grain separating plate respectively and FIGS. 2 and 4 show vertical sectional views thereof.

Figure 2:
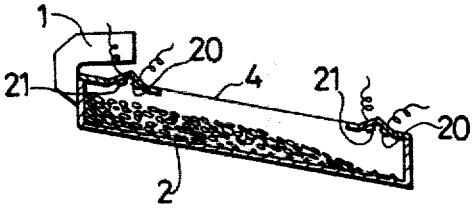

In FIGS. 1 and 2, when the flow of hulled rice is led out toward the front area forming a curved path, the rear area of a grain separating plate 2 is exposed to light and reflected rays caused by light source 20 which projects light rays onto the grain separating plate 2 are received and detected by a light receiving element 21. The output signal of the light receiving element 21 is applied to a driving means (not shown) to adjust the flow of the grain so that the exposed area of the grain separating plate 2 will be covered with unhulled rice.

The overall structure of the first embodiment for performing the above-mentioned operation is explained hereafter.

Figure 5:
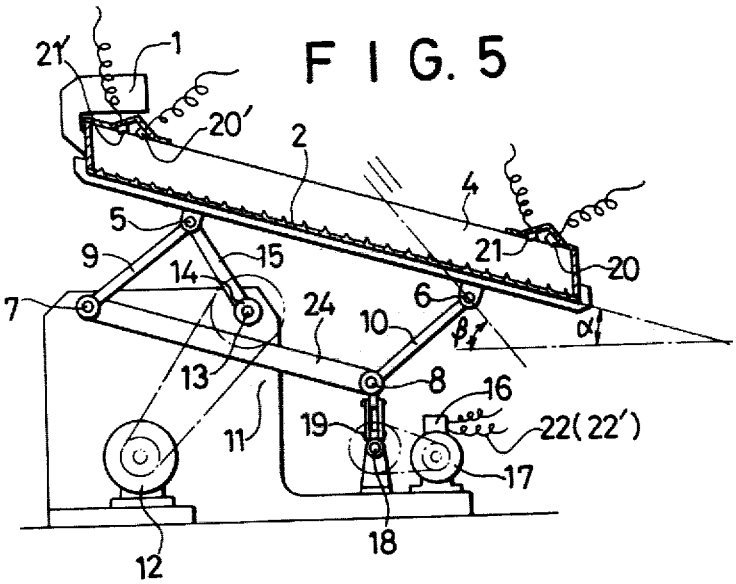
FIG. 5 is a vertical-sectional view of first embodiment according to the present invention.
Figure 6:
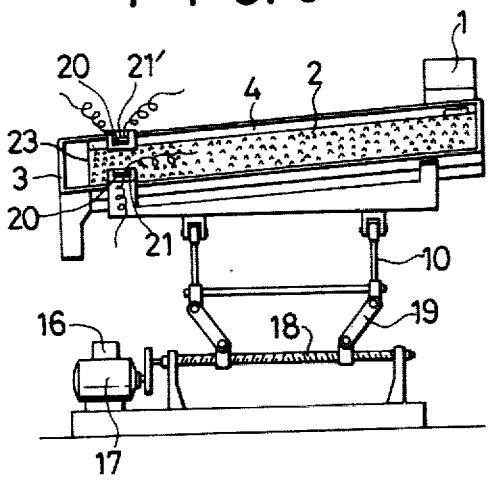
FIG. 6 is a front view of the first embodiment.

In FIGS. 5, 6, in the lower part of the hopper 1 into which the grain are supplied, a grain separating plate frame 4 comprising a rough surfaced grain separating plate 2 and side walls 3 constructed around the grain separating plate 2 is pivoted through oscillating levers 9, 10 by means of upper joints 5, 6.

At the lower joints 7, 8, the oscillating levers 9, 10 are pivoted toward the rotary lever 24 and the lower joint 7 of rotary lever 24 is pivoted in a frame 11.

An eccentric cam 14 connected to a main shaft 13 which is driven by main motor 12 and upper joint 5 is connected by means of a rod 15, and the grain separating frame 4 is oscillated back and forth at a oblique, forwardly elevated oscillating angle $\beta$. The upper areas of both adjusting levers 19 are threadably engaged at lower portions thereof with a threaded rod 18 which is driven clockwise and counterclockwise, respectively, by a control motor 17. The motor 17 is provided with a control driving means 16, the upper area of which is connected to the area near the lower joint 8 of the rotary lever 24, and both adjusting levers 19 on the threaded rod 18 are caused to oscillate in opposition to each other. Thus rotary lever 24 is rotated around the lower joint 7 to adjust the height of upper point 6 and thus the angle of elevation $\alpha$ of the grain separating plate 2 is adjusted.

At one side of the upper rear area of the grain separating plate frame 4 of the grain separating plate 2, a light source 20 which projects light to the grain separating plate 2 are positioned at such an angle so as to reflect and receive the light, respectively, at the upper front area of one side of the grain separating plate frame 4 of the grain separating plate 2. The light source 20 and the light receiving element 21 are erected in the same manner as mentioned above and light receiving elements 21, 21' and a control apparatus 16 of the drive means are connected to an electric circuit 22.

Mixed grain of hulled and unhulled rice supplied from the hopper 1 to the grain separating plate 2 are shaken up toward the front portion thereof by oscillation of the plate through angle $\beta$. Thus, unhulled rice grain of smaller specific gravity and of large coefficient of friction float upwardly over the hulled rice grain which have larger specific gravity and less coefficient of friction and which flow toward the rear in a curve. Hulled and unhulled rice grain are thereby separated to each side of the rear and front of the grain separating plate 2 and led out toward the end of a side 23.

The flow of either hulled or unhulled rice establishes a curve to the front or rear of the grain separating plate 2, as mentioned above, and when the exposed area appears and activates the driving means which is connected to the photoelectric means, the flow of grain is automatically adjusted to perform a stable and highly accurate grain separating operation.

Furthermore, using reflected light sensitive to the hue difference among grains, various kinds of grain can be detected. Therefore, using a specific mixture rate of the mixed grain, flow distribution of the grain particles can be adjusted. A filter may be used for detecting hue difference of grain.

Figure 7:
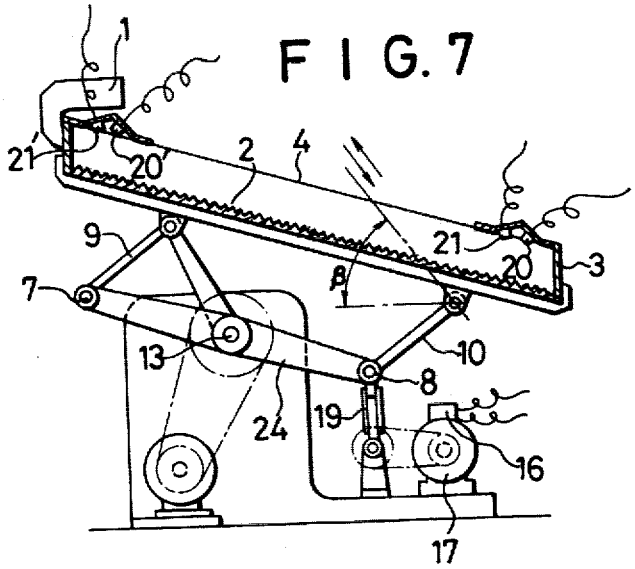
FIG. 7 is a vertical-sectional view of a second embodiment according to the present invention.
Figure 8:
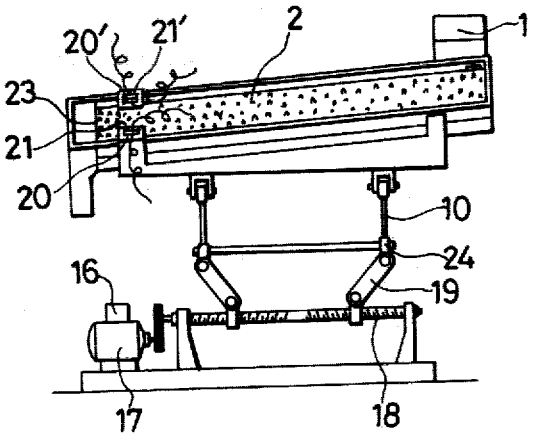
FIG. 8 is a front view of the second embodiment.

The entire construction of the second embodiment is shown in FIGS. 7 and 8. Oscillating levers 9, 10 are bridged to either ends of the rotary lever 24 which in turn is bridged to the main shaft 13 with an end thereof pivoted toward a lower point 8 connected to an adjusting lever 19.

By the clockwise or counterclockwise rotation of a control motor 17 of the drive means across a threaded shaft 18 and the adjusting lever 19, the lower point 8 moves up and down to adjust the angle of inclination of the rotary lever 24 and the oscillating angle $\beta$ of the grain separating plate 2 to perform a stable and highly accurate grain separating operation.

Figure 9:
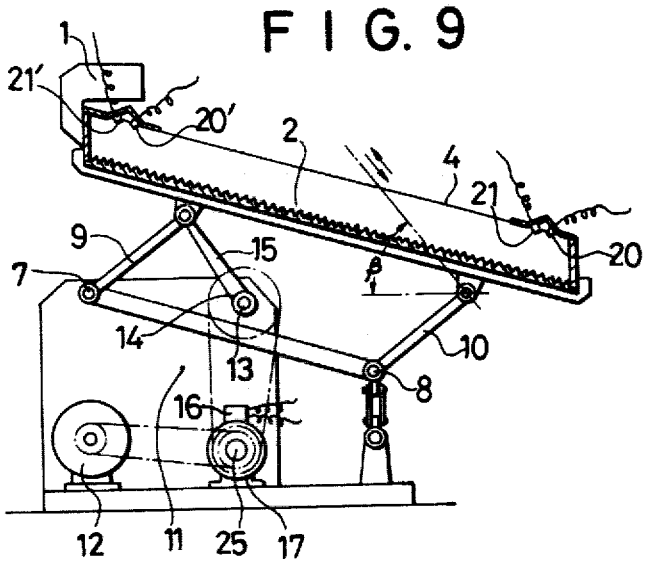
FIG. 9 is a vertical-sectional view of a third embodiment according to the present invention.

In FIG. 9, the construction of a third embodiment is shown, including an automatic control means 16 which is connected to light receiving elements 21, 21', and a variable speed means 25 actuated by a main motor 12, together with a main shaft 13 driven by the variable speed means 25.

The frequency of the grain separating plate 12 is controlled in order to automatically adjust the flow of hulled and unhulled rice on the grain separating plate 2, and a stable and highly accurate grain separating operation is performed.

Furthermore, a condenser lens is provided in the light path between the light source 20 and the light receiving element 21 to vary the amount of light received by the light receiving element 21 by increasing or decreasing the distance from the light source to the projected bodies. For example, the height of the grain, that is, the height of a layer of grain, actuates the operation of the driving means for adjusting the flow conditions of the grain.

Figure 10:
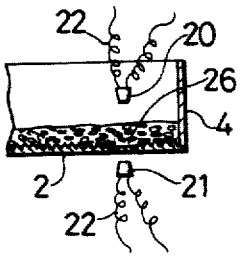
FIG. 10 is a vertical-sectional view of the principal parts of fourth embodiment according to the present invention.

FIG. 10 shows a fourth embodiment wherein at one front side and at one rear side of the grain separating plate 2, transparent windows 26 are provided, respectively. A downwardly facing light source 20 which projects light to a light receiving element 21 is provided above the grain separating plate 2 with its light receiving element 21 facing upwardly to detect the presence or thickness of the grain layer by status of the light ray which either passes or becomes intercepted or varies depending on the layer condition.

Figure 11:
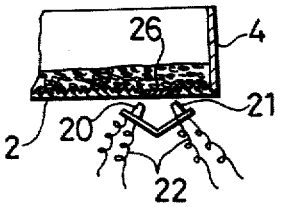
FIG. 11 is a vertical-sectional view of the principal parts of a fifth embodiment according to the present invention.

FIG. 11 shows a fifth embodiment wherein at one front side and one rear side of the grain separating plate 2, there are provided transparent windows 26, respectively, under each of which there are provided a light source 20 and a light receiving element 21. By detecting the reflected ray, a light receiving element 21 identifies the grain particles on the grain separating plate 2.

Figure 12:
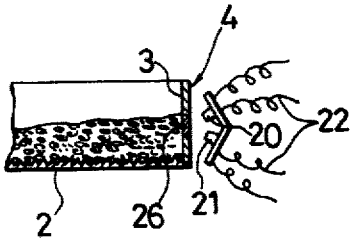
FIG. 12 is a vertical-sectional view of the principal parts of a sixth embodiment according to the present invention.

FIG. 12 shows a sixth embodiment wherein at one front side and one rear side of the grain separating plate 2, there are transparent windows 26 on the side-wall 3 provided with a light source 20 and a light receiving element 21. When the layers of unhulled rice are particularly thick, its top most layer is checked to adjust the excess flow of grain.

Figure 13:
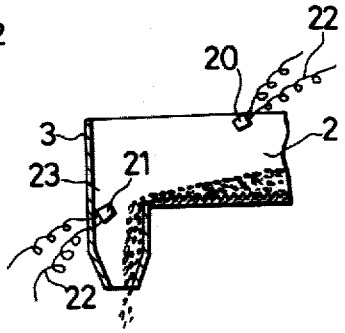
FIG. 13 is a vertical-sectional view of the principal parts of a seventh embodiment according to the present invention.

FIG. 13 shows a seventh embodiment wherein thickness of the unhulled rice layer flowing through one side of a front end 23 and at one side of a rear end 23 of the grain separating plate 2, respectively, is checked.

For this operation, the light receiving element 21 is located at the lower area of the side-wall 3 and the light source 20, which projects light to the light receiving element 21, is located at the upper area of the grain separating plate 2.

Due to the various thicknesses of the unhulled rice layer, the light ray is intercepted an in accordance with the interception, the unhulled rice is checked.

In another words, this invention checks unhulled rice flow, by transmitting light to the light receiving element from a light source, either with direct reflected light rays from the light source or projected light of the light-reflected ray.

Figure 14:
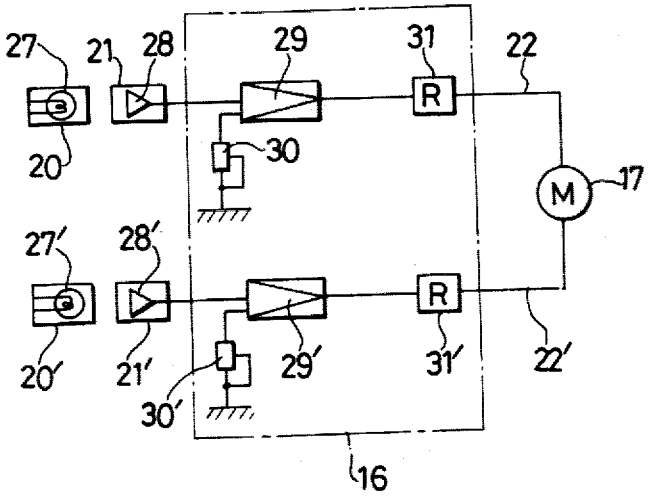
FIG. 14 is an electric circuit of the apparatus according to the present invention.

Next, FIG. 14 shows the electric circuit of the embodiment concerning a photoelectric apparatus. Light sources 20, 20' and light receiving elements 21,21' are connected to the driving means comprising an automatic control device 16 and a control motor 17. Light rays projected from electric lamps 27, 27' for the light source are received by photodiodes 28, 28' of the light receiving element 21, 21' and the generated voltage is amplified and the automatic control device 16 operates the variable resistors 30, 30' which determine their points of operation according to the amount of light.

In order to make the control motor 17 rotate clockwise or counterclockwise, the control device 16 including light receiving elements 21, 21', voltage amplifiers 29, 29' variable resistors 30, 30' and relays 31, 31', and a pair of electric circuits 22, 22' are connected to a control motor 17.

The electric circuit rotates the motor clockwise or counterclockwise and is an electromagnetic-type electric circuit which operates a clutch that in turn operates a transmission clockwise and counterclockwise. The transmission is driven by the motor which rotates in either direction.

The light source of the photoelectric apparatus in this invention is preferably an electric lamp such as an incandescent lamp, an arc lamp, a fluorescent lamp, or a luminous diode.

The photoelectric converting element, in other words, a light receiving element, is preferably a photoelectrotransducer element, such as a selenium cell, a silicon solar cell, a photodiode, a phototransistor, or a photo-electric discharging element such as a photoelectric tube, a photo-multiplier, a television camera tube, or an image tube.

A photoelectric converting element may also be located at either both front and rear portions of the grain separating plate or at either one of the sides of the grain separating plate.

I claim:

1. An automatic control apparatus for an oscillating grain separator comprising a grain separating frame having a sidewall, a separating plate having a roughened upper surface within said frame, a light source and a light receiving element mounted in a position to check flow conditions of grain on the grain separating plate, and located near at least one wall of the grain separating plate frame, means for positioning said plate and frame to provide an inclined surface for downward flow of grain, means for reciprocating said plate and frame, an adjusting lever, a control motor which rotates a threaded shaft threadedly engaged to the adjusting lever, a rotary lever which is swung by said adjusting lever, eccentric means connected to said grain separating plate frame and said rotary lever, oscillating levers supported on said rotary lever and connected to said separating plate frame, a first electrical circuit for controlling said control motor to adjust the flow conditions of said grain, and a second electrical circuit including said light receiving element for driving said first electrical circuit, said first electrical circuit including means for controlling said control motor so that an exposed portion on said grain separating plate is covered by said grain when said light receiving element detects exposure on said grain separating plate.

2. An automatic control apparatus as claimed in claim 1, wherein the light source and light receiving element are positioned in an upper portion of said grain separating plate frame.

3. An automatic control apparatus as claimed in claim 1, wherein said light source and light receiving element are positioned respectively in upper and lower portions of said grain separating plate frame with said grain separating plate between.

4. An automatic control apparatus as claimed in claim 1, wherein the light source and light receiving element are positioned in a lower portion of said grain separating plate frame.

5. An automatic control apparatus for an oscillating grain separator of a type comprising a grain separating frame having a sidewall, a separating plate having a roughened upper surface within said frame, means for positioning said plate and frame to provide an inclined surface for downward flow of grain, motor means for vertically reciprocating a lower end of said frame and simultaneously reciprocating an angle of inclination of said frame relative to a horizontal plane, said control apparatus comprising a stationary light source and a stationary light receiving element mounted in a position on said frame to check flow conditions of grain on the separating plate and located near at least one wall of the grain separating plate frame and circuit means responsive to said light receiving element for controlling said motor means to provide substantial grain separation on said separator plate.

* * * * *